US009768488B1

(12) United States Patent
Pontual et al.

(10) Patent No.: US 9,768,488 B1
(45) Date of Patent: Sep. 19, 2017

(54) DUAL PITCH JACK SCREW FOR ODU ALIGNMENT

(75) Inventors: Romulo Pontual, Palos Verdes, CA (US); Henry Derovanessian, Manhattan Beach, CA (US); Benjamin Mui, Los Angeles, CA (US); Gustave R. Stroes, Beverly Hills, CA (US)

(73) Assignee: THE DIRECTV GROUP, INC., El Segundo, CA (US)

( * ) Notice: Subject to any disclaimer, the term of this patent is extended or adjusted under 35 U.S.C. 154(b) by 637 days.

(21) Appl. No.: 13/494,853

(22) Filed: Jun. 12, 2012

(51) Int. Cl.

| | |
|---|---|
| ***H01Q 3/02*** | (2006.01) |
| ***H01Q 1/12*** | (2006.01) |
| *H01Q 3/06* | (2006.01) |
| *H01Q 3/04* | (2006.01) |

(52) U.S. Cl.
CPC ..... *H01Q 1/12* (2013.01); *H01Q 1/125* (2013.01); *H01Q 1/1257* (2013.01); *H01Q 3/02* (2013.01); *H01Q 3/04* (2013.01); *H01Q 3/06* (2013.01)

(58) Field of Classification Search
CPC ..... H01Q 1/12; H01Q 1/125; H01Q 1/1257; H01Q 3/02; H01Q 3/04; H01Q 3/06
USPC ..... 343/757, 763, 882; 74/1 R, 491; 342/359
See application file for complete search history.

(56) References Cited

U.S. PATENT DOCUMENTS

| | | | | | |
|---|---|---|---|---|---|
| 4,126,865 | A * | 11/1978 | Longhurst | H01Q 3/08 | 343/766 |
| 4,216,909 | A * | 8/1980 | Carlin | 239/265.31 | |
| 4,232,320 | A * | 11/1980 | Savalle, Jr. | H01Q 3/08 | 343/765 |
| 4,251,819 | A * | 2/1981 | Vickland | H01Q 1/125 | 343/765 |
| 4,454,515 | A * | 6/1984 | Major | H01Q 1/125 | 248/122.1 |
| 4,475,110 | A * | 10/1984 | Hutchins | H01Q 3/08 | 343/766 |
| 4,528,569 | A * | 7/1985 | Felter | H01Q 15/168 | 343/840 |
| 4,602,259 | A * | 7/1986 | Shepard | H01Q 3/08 | 33/268 |
| 4,626,864 | A * | 12/1986 | Micklethwaite | H01Q 3/04 | 248/183.2 |
| 4,652,890 | A * | 3/1987 | Crean | H01Q 1/125 | 248/185.1 |
| 4,821,047 | A * | 4/1989 | Williams | H01Q 3/08 | 343/765 |
| 4,875,052 | A * | 10/1989 | Anderson | H01Q 3/08 | 248/183.2 |
| 5,075,682 | A * | 12/1991 | Dehnert | 342/352 | |
| 5,077,561 | A * | 12/1991 | Gorton | G01S 3/42 | 342/359 |
| 5,358,265 | A * | 10/1994 | Yaple | 280/293 | |
| 5,579,018 | A * | 11/1996 | Francis et al. | 343/757 | |
| 6,538,602 | B2 * | 3/2003 | Natsume et al. | 342/359 | |

* cited by examiner

*Primary Examiner* — Joseph Lauture
(74) *Attorney, Agent, or Firm* — Gates & Cooper LLP

(57) ABSTRACT

A method, apparatus and system for aligning an antenna reflector with satellites in a satellite configuration.

20 Claims, 6 Drawing Sheets

DUAL PITCH JACK SCREW FOR ODU ALIGNMENT

BACKGROUND OF THE INVENTION

Field of the Invention

The present invention relates generally to a satellite receiver system, and in particular, to an alignment method and apparatus for multi-satellite consumer receiver antennas.

Description of the Related Art

Satellite broadcasting of communications signals has become commonplace. Satellite distribution of commercial signals for use in television programming currently utilizes multiple feedhorns on a single Outdoor Unit (ODU) which supply signals to multiple receivers and/or Integrated Receiver/Decoders (IRDs), on separate cables from a multiswitch or on a single wire delivery system.

Typically, an antenna is pointed toward the southern sky, roughly aligned with the satellite downlink beam(s), and then fine-tuned using a power meter or other alignment tools. The precision of such an alignment is critical. The satellites require somewhat exacting alignment methods, and the span of sky that must be aligned to is difficult to achieve, and without exacting alignment of the antenna dish, the signals from the satellites will not be properly received, rendering these signals useless for data and video transmission.

Further, the installation and alignment of the ODU is relatively difficult in the power peaks of several different satellites at different locations must be found and the alignment of the satellite must be moved to these peaks in an exacting manner.

It can be seen, then, that there is a need in the art for an alignment method for a satellite broadcast system that is easily achieved and can be easily replicated in the field.

SUMMARY OF THE INVENTION

To minimize the limitations in the prior art, and to minimize other limitations that will become apparent upon reading and understanding the present specification, the present invention discloses a method and apparatus for aligning a multi-satellite receiver antenna, and more specifically, a method, apparatus and system for aligning an antenna reflector with satellites in a satellite configuration. A method in accordance with the present invention comprises roughly aligning a reflector with a first signal based on a geographic location of the reflector, passing the reflector through an arc in a first alignment direction by turning a coarse jack screw in a first direction until a first predetermined location is reached, returning the reflector through the arc to a second predetermined location by turning the coarse jack screw in a second direction, the second predetermined location being based on a number of turns of the coarse jack screw in the second direction, and passing the reflector back through the arc by turning a fine jack screw, wherein turning the fine jack screw by the same number of turns moves the reflector half of the distance through the arc in the first direction.

Such a method further optionally comprises the coarse jack screw and the fine jack screw being turned using a transmission device, the transmission device comprises splines to selectively engage the coarse jack screw and the fine jack screw, the first alignment direction being an elevation direction, passing the reflector through a second arc in a second alignment direction by turning a second coarse jack screw in a first direction until a third predetermined location is reached, returning the reflector through the second arc to a fourth predetermined location by turning the second coarse jack screw in a second direction, the fourth predetermined location being based on a number of turns of the coarse jack screw in the second direction, and passing the reflector back through the second arc by turning a second fine jack screw, wherein turning the second fine jack screw by the same number of turns moves the reflector half of the distance through the arc in the first direction, and the coarse jack screw and the fine jack screw being concentric.

An alignment system in accordance with one or more embodiments of the present invention comprises a coarse jack screw, a fine jack screw, and a reflector, coupled to the coarse jack screw and the fine jack screw, wherein a turn of the coarse jack screw moves the reflector a first distance in a first direction and a turn of the fine jack screw moves the reflector half of the first distance in the first direction.

Such an alignment system further optionally comprises a transmission device, coupled to the coarse jack screw and to the fine jack screw, wherein the transmission device selectively engages the coarse jack screw and the fine jack screw, the transmission device being coupled to the coarse jack screw and to the fine jack screw with a splined interface, the coarse jack screw and the fine jack screw being concentric, and the coarse jack screw being turned in a direction opposite that of the fine jack screw to move the reflector in the first direction.

An alignment system for a satellite broadcasting system in accordance with one or more embodiments of the present invention comprises a terrestrial antenna comprising a reflector, the terrestrial antenna being aligned in azimuth and elevation with at least a first satellite signal transmitted by a first satellite in the satellite broadcasting system, wherein a coarse jack screw moves the reflector a first amount in an alignment axis per turn of the coarse jack screw, and a fine jack screw moves the reflector a second amount in the alignment axis per turn of the fine jack screw.

Such a system further optionally comprises the first amount being twice the second amount, the coarse jack screw and the fine jack screw being turned using a transmission device, the transmission device comprising splines to selectively engage the coarse jack screw and the fine jack screw, the coarse jack screw and the fine jack screw being concentric, and a first coarse jack screw and a first fine jack screw align the reflector in elevation and a second coarse jack screw and a second fine jack screw align the reflector in azimuth.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

Figure 1:
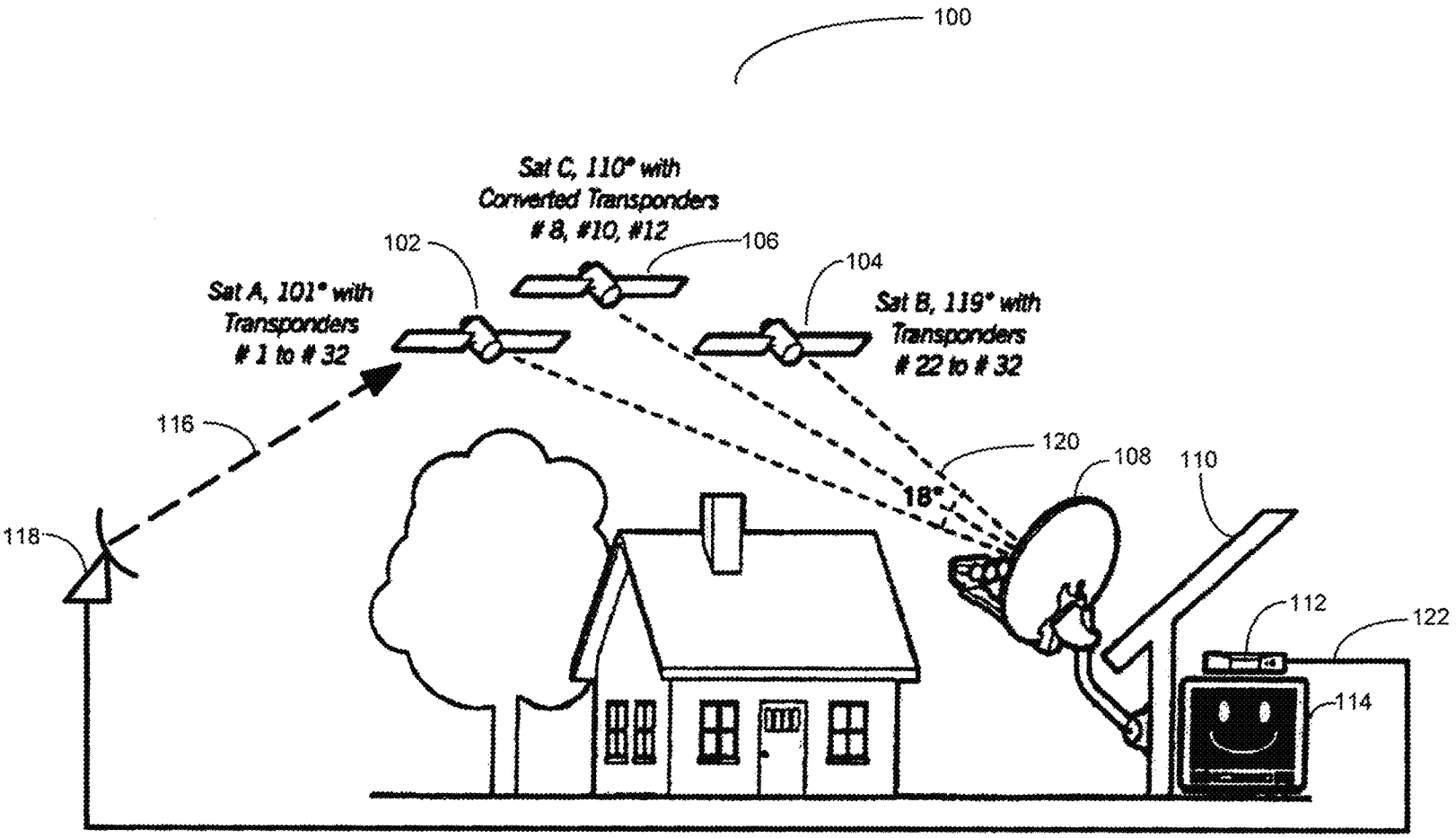
FIG. 1 illustrates a satellite constellation and system of the present invention.

FIG. 1 illustrates a satellite constellation of the present invention.

System 100 uses signals sent from Satellite A (SatA) 102, Satellite B (SatB) 104, and Satellite C (SatC) 106 (with transponders 28, 30, and 32 converted to transponders 8, 10, and 12, respectively), that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

The orbital locations of satellites 102-106 are fixed by regulation, so, for example, there is a satellite at 101 degrees West Longitude (WL), SatA 102; another satellite at 110 degrees WL, SatC 106; and another satellite at 119 degrees WL, SatB 104. Satellite 103 is located at 102.8 degrees WL, and satellite 105 is located at 9902 degrees WL. Other satellites may be at other orbital slots, e.g., 72.5 degrees, 95 degrees, and other orbital slots, without departing from the scope of the present invention. The satellites are typically referred to by their orbital location, e.g., SatA 102, the satellite at 101 WL, is typically referred to as "101."

Satellites 102, 104, and 106 broadcasts downlink signals 120 in typically thirty-two (32) different frequencies, which are licensed to various users for broadcasting of programming, which can be audio, video, or data signals, or any combination. These signals are typically located in the Ku-band of frequencies, i.e., 11-18 GHz. Satellites 103 and 105 typically broadcast in the Ka-band of frequencies, i.e., 18-40 GHz, but typically 20-30 GHz.

Alignment Procedures

Figure 2:
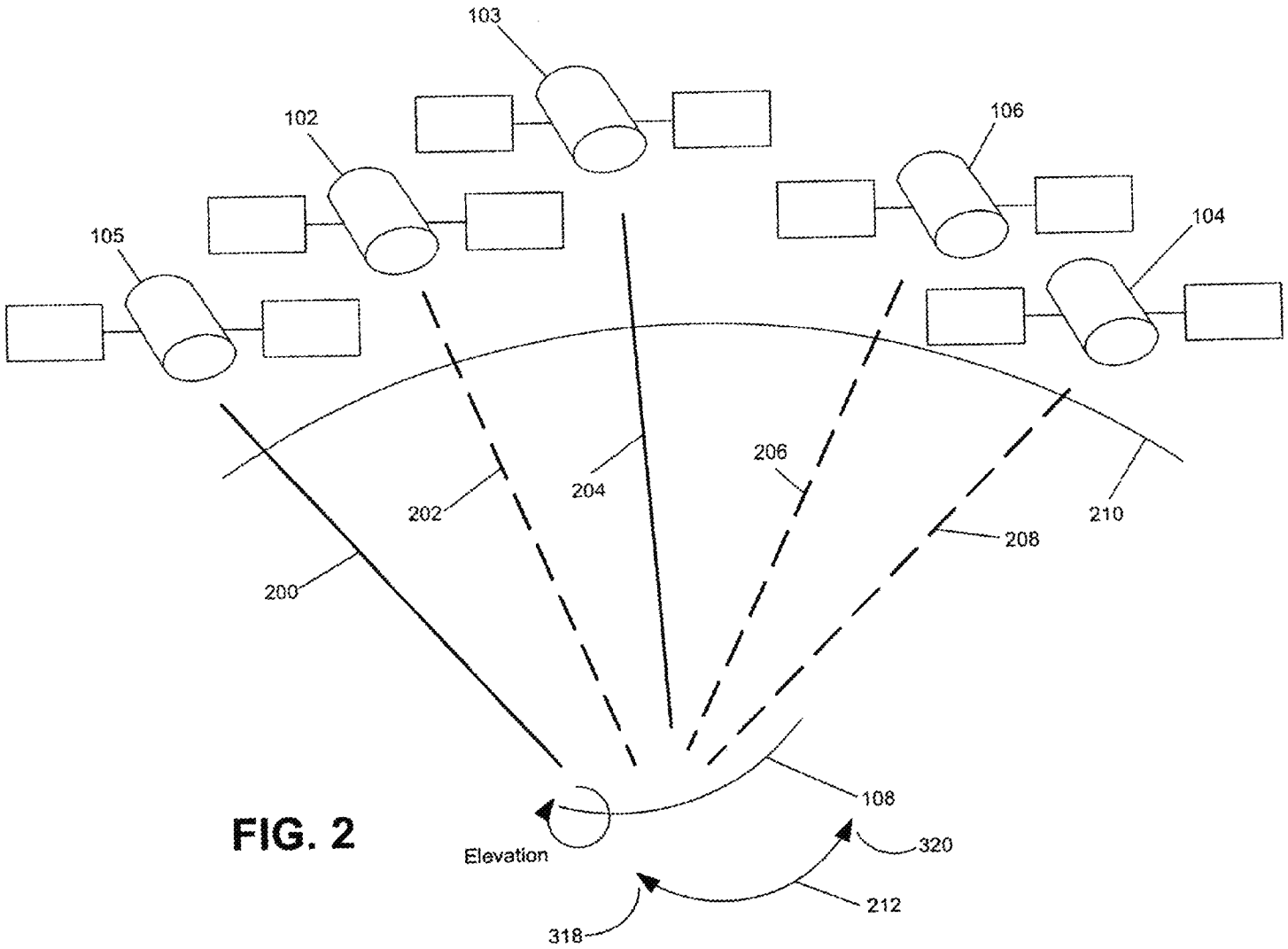
FIG. 2 illustrates an alignment in accordance with the related art.

FIG. 2 illustrates an alignment in accordance with the related art.

ODU 108 must receive signals 200-208, collectively referred to as downlink signals 120, on the reflector dish that is part of ODU 108. The reflector dish reflects downlink signals to feedhorns for reception, and on to other electronics for processing.

Signals 200 and 204, which are transmitted by satellites 105 and 103 respectively, are transmitted in the Ka-band of frequencies, typically at frequencies of 18.3-18.8 GHz and 19.7-20.2 GHz. These transmissions are shown as solid lines for signals 200 and 204. Signals 202, 206, and 208 are transmitted in the Ku-band of frequencies, typically at the 12.2-12.7 GHz range.

Satellites 102-106 are located in geosynchronous orbital locations that are on an arc 210, also known as the "Clarke Belt." To properly align ODU 108 to satellites 102-106, if any two points on the arc 210 are aligned with respect to ODU 108, the remainder of the points will be aligned as well, and, as such, by aligning ODU 108 to two satellites 102-106, the remainder of satellites 102-106 will automatically align.

Typically, alignments are done with respect to the most sensitive feature of the alignment. In this case, the most sensitive alignment feature would be signals 200 and 204, because at their higher frequency of transmission, the losses and alignment errors for these signals 200 and 204 would be most affected by misalignment of ODU 108 with arc 210.

Azimuth, Elevation, and Tilt (Skew or Rotation)

Figure 3:
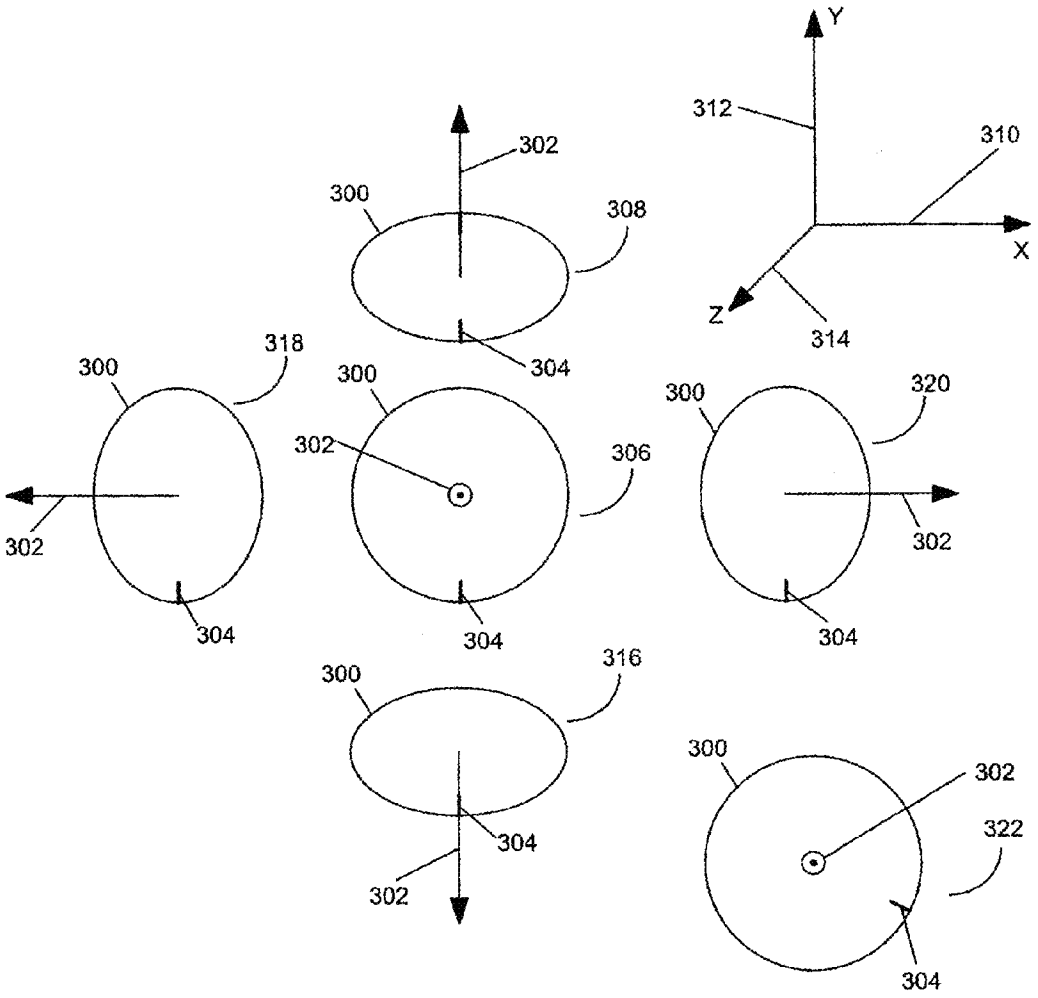
FIG. 3 illustrates azimuth, elevation, and rotational adjustments of an ODU with respect to the present invention.

FIG. 3 illustrates azimuth, elevation, and rotational adjustments of an ODU with respect to the present invention.

Antenna reflector 300 is shown, with boresight 302 and rotational mark 304 illustrated. Although boresight 302 is shown substantially at the center of antenna reflector 300, boresight 302 can be at other locations without departing from the scope of the present invention.

As shown in configuration 306, reflector 300 is pointed directly out of the page, with boresight 302 showing the end of the arrow in standard notation. The boresight 302 is pointed directly at the viewer.

In configuration 308, reflector 300 is rotated around the x-axis 310, and is held constant with respect to y-axis 312 and z-axis 314. As such, reflector is tilted "up," e.g., away from the plane of the page, and, as such, boresight 302 points up. This is considered an increase in the elevation of reflector 300.

In configuration 316, reflector 300 is rotated in the opposite direction around the x-axis 310 with regard to the direction of rotation in configuration 308, and is again held constant with respect to y-axis 312 and z-axis 314. As such, reflector is tilted "down," e.g., away from the plane of the page, and, as such, boresight 302 points down. This is considered a decrease in the elevation of reflector 300.

In configuration 318, reflector 300 is rotated around the y-axis 312, and is held constant with respect to x-axis 310 and z-axis 314. As such, reflector is tilted "left," e.g., away from the plane of the page, and, as such, boresight 302 points left. This is considered an increase in the azimuth of reflector 300.

In configuration 320, reflector 300 is rotated in the opposite direction around the y-axis 312 with regard to the direction of rotation in configuration 308, and is again held constant with respect to x-axis 310 and z-axis 314. As such, reflector is tilted "right," e.g., away from the plane of the page, and, as such, boresight 302 points right. This is considered a decrease in the azimuth of reflector 300.

In configuration 322, reflector 300 is rotated around the z-axis 314, and is held constant with respect to x-axis 310 and y-axis 312. As such, reflector is rotated "counterclockwise," e.g., in the plane of the page and to the right, and, as such, rotational mark is no longer at the bottom of reflector 300, but has moved to the right. This is considered an increase in the tilt (also called skew or rotation) of reflector 300.

To properly align reflector 300, and, as such, ODU 108 of which reflector 300 is a part, the reflector 300 must be pointed at the proper azimuth, elevation, and tilt to be able to receive signals from satellites 102-106.

Returning to FIG. 2, azimuth mark 212 shows the positive direction configuration 318 and negative direction configuration 320 of azimuth movement of ODU 108 (and reflector 300). As ODU 108 is moved along azimuth line 212 in a positive direction, the signals 200, 202, and 204 will be better received by ODU 108; similarly, when ODU 108 is moved along azimuth line 212 in a negative direction, signals 206 and 208 will be better received by ODU 108. As such, the present invention uses a method that maximizes the power received from all signals 200-204, with a bias toward signals 200 and 204.

For a given set of locations on the earth, aligning ODU 108 to the true peaks of Ku-band signals 202 and 208 will result in minimum azimuth, elevation, and tilt pointing errors, because signals 202 and 208 are approximately located at the two ends of the arc 210 that the ODU 108 needs to be aligned to. Once proper elevation is achieved, by proper mechanical feedhorn positioning, any additional satellites, as well as satellites 102-106, are automatically aligned in their optimal respective positions. Further, predictable errors can be anticipated for locations that have special needs, e.g., where the satellites 102-106 are viewed in a pattern different than the optimal arc 210.

Typically alignment procedures use signal 202, from satellite 102, as the main alignment point. Azimuth and elevation are set using signal 202, which is at the Ku-band, which minimizes topocentric variations across a large geographic area (e.g., the continental United States, or "CONUS,"), for signals 200 and 204. Signal 208 is typically used to ensure proper rotational alignment, i.e., tilt, of ODU 108. The use of signals 202 and 208 for alignment purposes provides proper alignment of ODU 108 in all three of the alignment directions, namely, azimuth, elevation, and tilt.

Typically, the use of signals 202 and signal 208 is performed in a recursive manner, e.g., find the best reception of signal 202 using azimuth and elevation adjustments to ODU 108, then find the best reception of signal 208 using tilt adjustments to ODU 108, then re-check the reception of signal 202 using azimuth and elevation adjustments to ODU 108, etc., until the ODU 108 is optimally aligned in azimuth, elevation, and tilt to signals 202 and 208. Other signals can be used without departing from the scope of the present invention.

It is also contemplated within the scope of the present invention that after maximizing the signal reception of signals 202 and 208, that ODU 108 can be offset from this position to maximize the reception of signals 200 and 204. Such an offset can be performed based on geoposition (i.e., where on the earth ODU 108 is located), where an offset in one geographical location is different than the offset in another geographical location. For example, and not by way of limitation, the offset in Portland, Me., may be different than the offset in San Diego, Calif., because of the latitude and/or longitude differences between those two cities. The offset may occur in one or more of the three alignment axes.

Alignment Strategy and Dithering Process

The related art alignment adjustment is roughly set, typically based on local longitude and latitude. The Azimuth and Elevation adjustments are performed by sweeping the ODU 108 through maximum signal strength peaks, and then fine tuned in elevation and then azimuth.

The related art method to fine tune the ODU 108 in a given alignment axis, say elevation, is that the installer turn the adjustment screw a certain number of turns away from the rough alignment adjustment, e.g., three turns, in a given direction, and then turns the screw in the opposite direction until the meter gives an indication to stop turning or some power level is reached. Once the indication is made, and the installer stops turning the adjustment screw, and the lockdown bolts are tightened to complete the adjustment.

The azimuth fine-tuning is similar to that of the elevation fine-tuning. The installer turns the azimuth screw a certain number of turns, e.g., three turns, in a given direction, and presses a button on the meter. The meter then prompts the installer to turn the screw in the opposite direction, and indicates where to stop. The lockdown bolts are then tightened to complete the azimuth adjustment.

This existing method used to align ODUs 108 involves what is called "dithering." The ODU 108 is first roughly aligned with the beacon (satellite) and then moved some distance off of the rough beam peak. The signal strength is measured at this alignment point. Then a dial on a single jack screw is zeroed. The jack screw is subsequently turned to move the ODU 108 through beam center (the maximum signal strength) to the opposite side of the beam pattern, until such a point as an identical reading to the "zero point" is seen on the signal meter.

The number of full (and partial) turns of the jack screw that were required is noted down by the installer. This number of turns is now divided in half. The dial on the jack screw is zeroed out again, and the jack screw is turned one half the number of turns back towards the beam peak. When performed properly this procedure will put the ODU 108 pattern with its peak centered on the beacon (satellite). The existing procedure involves several steps, and is somewhat cumbersome, with several areas for error and inaccuracy. The steps are summarized as follows:

1. Turn jack screw approximately 3 turns CCW away from the coarse beam peak.
2. Take a signal meter reading and record
3. Zero out the dial on the jackscrew.
4. Drive the jack screw in the CW direction approximately 6 turns, until the same signal meter reading is reached as in step 2.
5. Record the actual number of turns and partial turns required to reach the same signal strength point.
6. Divide this number of turns by two and record.
7. Zero out the dial on the jackscrew.
8. Rotate the jackscrew CCW exactly the number of turns recorded in step 6.
9. Lockdown the alignment axis As can be seen, there are several areas for error. The jackscrew will have hysterisis issues in that the same screw is being turned in two different directions. Further, a partial turn has the opportunity to be "estimated" by the installer, and the return path of step 8 also has the ability to be estimated as to when that point is reached by the installer. As such, the related art approach either requires several iterations to ensure that the beacon (satellite) signal is truly aligned, or will have some inherent errors and inaccuracies.

Scintillation

The rate at which the installer performs this alignment procedure also becomes important, because the meter must sample the measured strength and store it often enough such that the meter can capture the peak of the satellite beams. However, the Ka-band spectrum is subject to scintillation, which is a fluctuation of the power because of atmospheric effects, even when the ODU 108 is not moved. Thus, the installer may not accurately measure the second point (after sweeping through the beam peak) and the hysterisis and estimation issues in addition to the scintillation delay will potentially align the ODU 108 inaccurately.

Multiple Jack Screw Approach

Related art approaches use a single jack screw for each orientation; one jack screw for azimuth, a second jack screw for elevation, and a third jack screw for tilt. The present invention uses multiple jack screws, with different thread pitch counts, and an optional transmission, to more precisely move the ODU 108 in one or more axes.

Again, a dithering approach is used, such that each side of the beam pattern in one or more of the alignment axes is encountered during the alignment procedure. Since one or more of the alignment axes may be less sensitive to alignment errors, either systematically or in specific geographical areas, the present invention may only be supplied on those axes that require a more precise alignment.

The present invention comprises two jack screws, one with a thread pitch which is half as fine as that of the second jack screw. These may be co-linear or can be otherwise arranged to engage the ODU 108. The screws are optionally rotated via a separate part, herein called the transmission, and optionally inter-connected by splines.

The transmission can be moved so that it engages either the fine pitch screw, or the coarse pitch screw, but not both.

The present invention simplifies the dithering alignment procedure. With two dual-pitch jack screws, one being half the thread pitch of the other, the alignment can be performed in a far simpler manner than with present related art techniques. The estimation and division procedures are eliminated, and the jack screw readout dial does not need to be rotated to zero, as the jack screw remains attached to the transmission mechanism. The steps are summarized as follows.

1. With transmission in Coarse position, turn jack screw drive at least 3 turns CCW away from the coarse beam peak until the fixed dial reads zero.
2. Take a signal meter reading and record
3. Drive the jack screw in the CW direction until the same signal meter reading is reached
4. Move drive transmission to Fine position
5. Rotate the jackscrew CCW until the fixed dial reads zero again
6. Lockdown the alignment axis As can be seen, the number of steps required to align a particular axis is reduced from 9 to 6. Further, the cumbersome requirement to record the "estimated" number of turns and divide by 2 is no longer necessary.

The present invention speeds up and simplifies the ODU 108 alignment procedure. This allows for more efficient installation as well as increasing the likelihood that alignment is accurate and providing the greatest possible signal strength for customers. The present invention also eases the installation requirements such that customers can install the ODU 108 themselves, saving money for both customers and system providers.

Block Diagram

Figure 4:
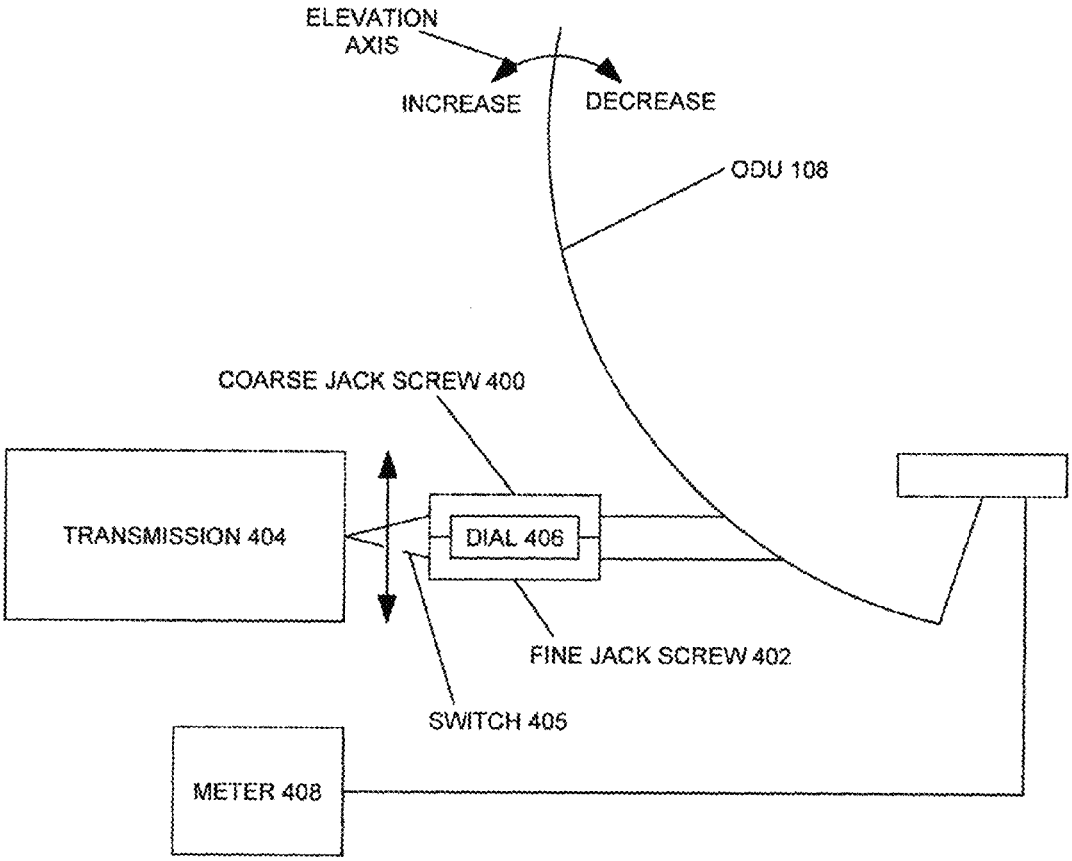
FIG. 4 illustrates a block diagram of one or more embodiments of the present invention.

FIG. 4 illustrates a block diagram of one or more embodiments of the present invention.

ODU 108 is shown, with a coarse jack screw 400, fine jack screw 402, and optional transmission 404 coupled to ODU 108. The jack screws 400 and 402 can be coupled to ODU in any manner, e.g., in a co-linear fashion such that the jack screws 400 and 402 couple to essentially the same location on the ODU 108, or can be placed in locations on ODU 108 such that jack screws 402 and 404 have counteracting effects on each other. The present invention does not limit the coupling of jack screws 400 and 402 to ODU.

The ODU 108 is roughly aligned in azimuth, elevation, and tilt. The jack screws 400 and 402 shown in FIG. 4 align only one axis, e.g. the elevation axis; other jack screws 400 and 402 can be used on other axes and can be included in the present invention without departing from the scope of the present invention.

Optional transmission 404 is used to control engagement of the jack screws 400 and 402. Of course, the jack screws can be engaged separately by the installer if desired, e.g., there can be two physical screws, one next to or inside the other, that are optionally coupled together such that the installer merely switches manually between the coarse jack screw 400 and the fine jack screw 402 with a screwdriver or other tool.

Further, jack screws 400 and 402 can be designed such that the jack screws 400 and 402 are always turned in the same direction by changing the "handedness" of the threads. So, for example, turning coarse jack screw 400 CW with standard (also known as right handed) threads would typically "tighten" or move coarse jack screw 400 closer to ODU 108, which would increase the elevation of ODU 108 as shown in FIG. 4. Turning a standard thread fine jack screw 402 CCW would decrease the elevation of ODU 108 as shown in FIG. 4, however, if fine jack screw 402 had reverse (also known as left handed) threads, then fine jack screw can be turned CW to decrease the elevation of ODU 108. Such instructions can be provided on the ODU 108 or along with ODU 108 if such an arrangement is used.

Once the ODU 108 is coarsely aligned, the installer then turns the coarse jack screw 400, either through transmission 404 or directly, a given number of turns away from the coarse beam peak alignment point. For normal threading, a CCW turn of coarse jack screw 400 will lower the elevation of ODU 108 as shown in FIG. 4. Once the zero point on the dial 406, which is coupled to the jack screws 400 and 402 and/or the transmission 404 is reached by turning coarse jack screw 400 in a CCW direction, a meter 408 reading is recorded regarding the received signal strength at the zero point of the dial 406.

Coarse jack screw 400 is then turned CW until the meter 408 goes through the beam peak and meter 408 again reads the same received signal strength as at the zero point of the dial 406. This has increased the elevation of ODU 108 as shown in FIG. 4.

Now the transmission 404 is switched via switch 405 to engage fine jack screw 402. For concentric and other couplings of coarse jack screw 400 and fine jack screw 402, fine jack screw 402 has a thread pitch that is exactly half of coarse jack screw 400. For example, and not by way of limitation, if coarse jack screw 400 has a thread pitch of 20 (i.e., 20 threads per inch) then fine jack screw 402 would have a thread pitch of 40 (i.e., 40 threads per inch). If coarse jack screw 400 and fine jack screw 402 are coupled in different manners to ODU 108, they can have different thread pitch relationships or the same thread pitch; for example, and not by way of limitation, by placing coarse jack screw 400 at a location where it will move ODU 108 twice as far per turn as the location of fine jack screw 402, then jack screws 400 and 402 can have the same thread pitch and the present invention will still function as described. Many other relationships between coarse jack screw 400 and fine jack screw 402 are possible given the teachings of the present specification.

Now that fine jack screw 402 is engaged, either via transmission 404 or otherwise, fine jack screw 402 (having the same thread handedness as coarse jack screw 400) is turned (given the 2:1 ratio of thread pitches described in this example) the same number of turns in the opposite direction as coarse jack screw 400 was, which will zero the dial 406.

Since there is an exact relationship between the jack screws 400 and 402, the estimation of number of turns, hysterisis, etc., are minimized or eliminated in the method and apparatus of the present invention. Transmission 404 can also be designed to take into account the hysterisis issues in further detail as desired or needed by the alignment system utilizing the present invention.

The transmission 404 is always connected to one of the jack screws 400 or 402, but never to both, and transmission 404 should be easily moved from one jack screw 400 to the other 402. With the present invention, it is now possible to rotate the coarse jack screw 400 and the fine jack screw 402, and any other jack screws as desired, in sequence.

This process and the apparatus shown in FIG. 4 can be repeated for azimuth alignment and/or tilt alignment of ODU 108 as needed or desired.

Concentric Embodiment of Dual Jack Screw

Figure 5:
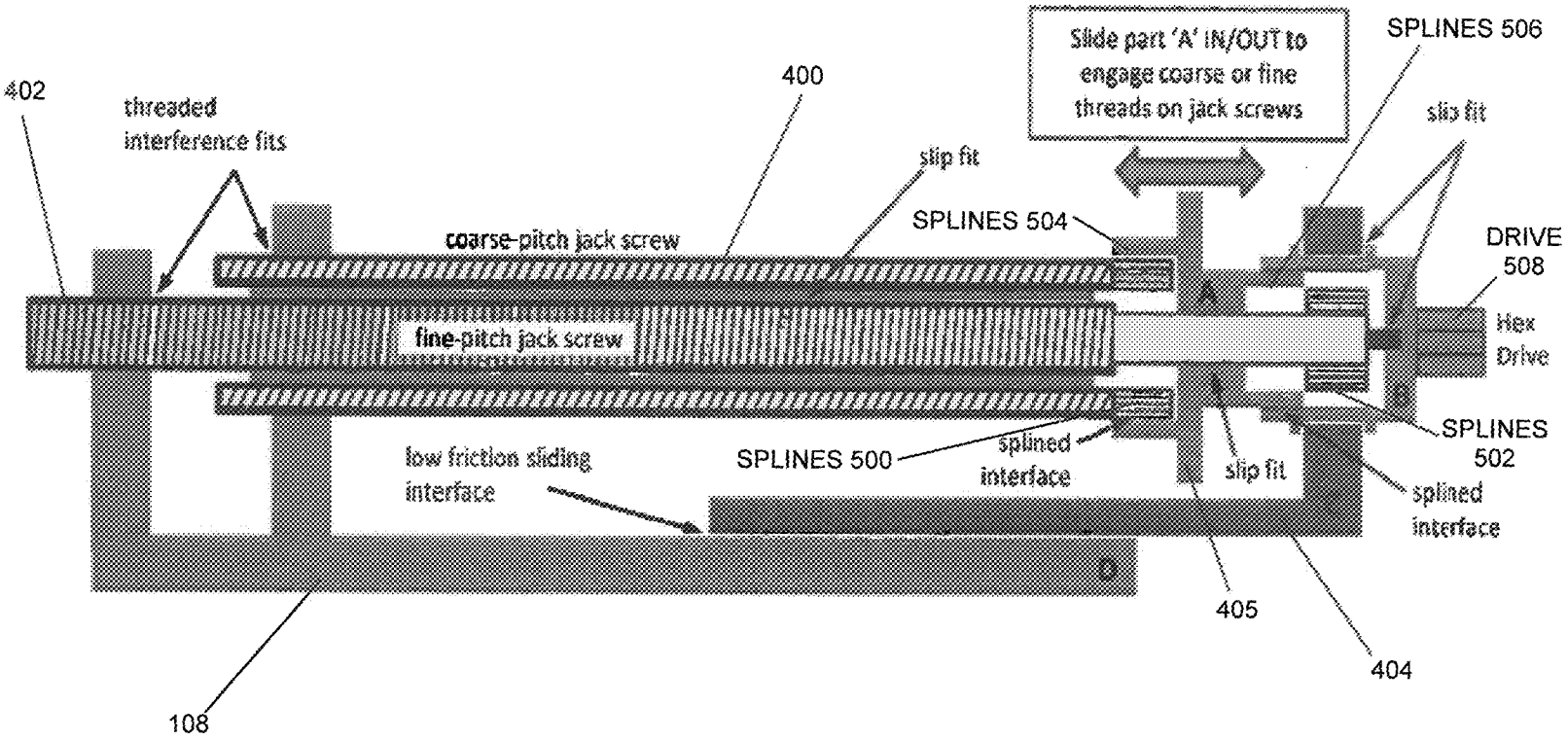
FIG. 5 illustrates a cutaway view of one or more embodiments of a concentric dual jack screw of the present invention.

FIG. 5 illustrates a cutaway view of one or more embodiments of a concentric dual jack screw of the present invention.

As shown in FIG. 5, coarse jack screw 400 is concentric with fine jack screw 402, which both engage ODU 108 in a given axis. Transmission 404 comprises switch 405, which engages splines 500 and 502 attached to coarse jack screw 400 and 402 respectively, via splines 504 and 506 on switch 405. Drive mechanism 508, typically a hex drive but can be other types of drives, is turned or otherwise operated to turn jack screws 400 and 402. Switch 405 engages either of the jack screws 400 or 402 based on the engagement of splines 504 with splines 500 or splines 506 with splines 502.

Process Chart

Figure 6:
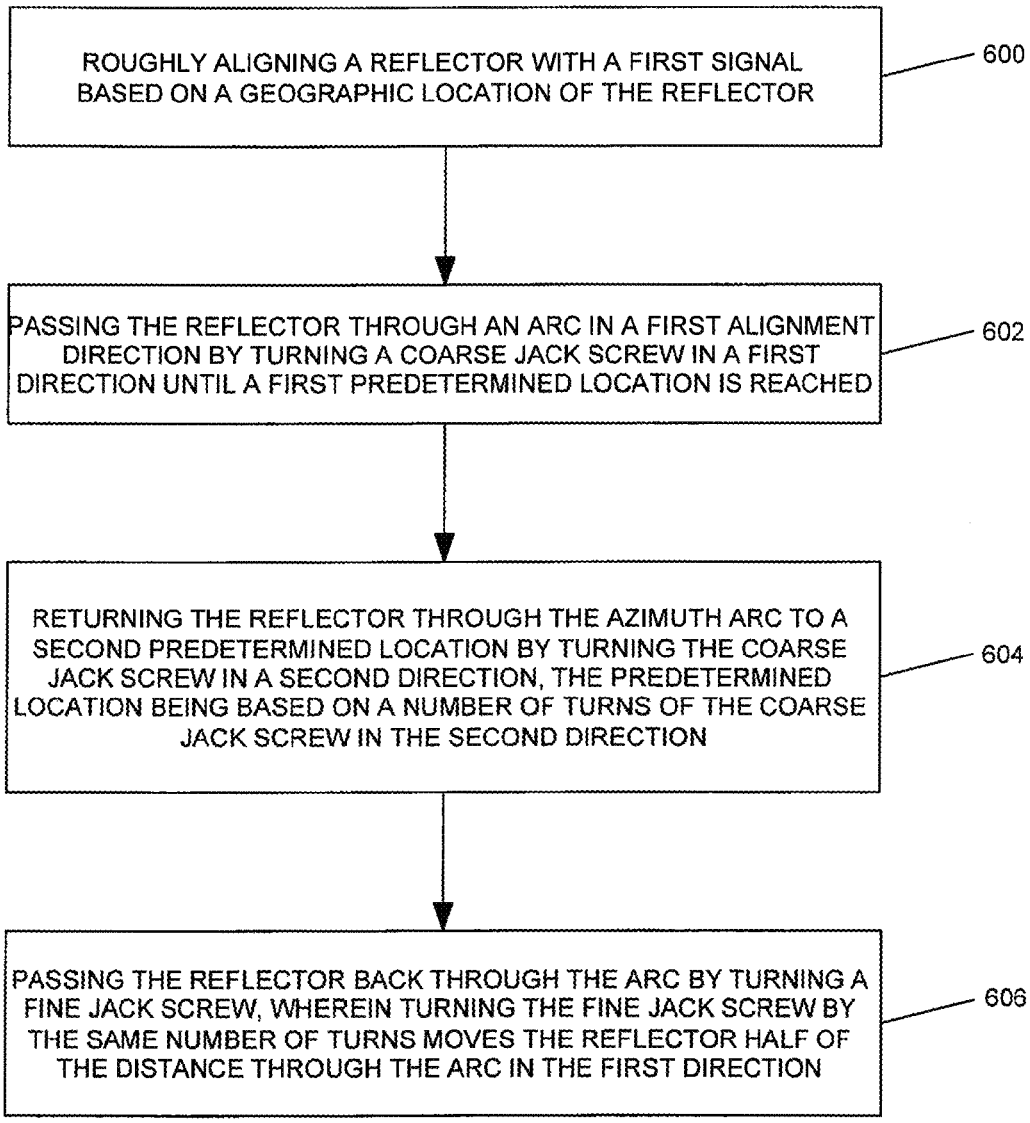
FIG. 6 illustrates a process chart in accordance with one or more embodiments of the present invention.

FIG. 6 illustrates a process chart in accordance with one or more embodiments of the present invention.

Box 600 illustrates roughly aligning a reflector with a first signal based on a geographic location of the reflector.

Box 602 illustrates passing the reflector through an arc in a first alignment direction by turning a coarse jack screw in a first direction until a first predetermined location is reached.

Box 604 illustrates returning the reflector through the azimuth arc to a second predetermined location by turning the coarse jack screw in a second direction, the predetermined location being based on a number of turns of the coarse jack screw in the second direction.

Box 606 illustrates passing the reflector back through the arc by turning a fine jack screw, wherein turning the fine jack screw by the same number of turns moves the reflector half of the distance through the arc in the first direction.

The process steps can be repeated for a second direction, and a third direction, or can be repeated for the first direction if desired, before or after alignment with one of the other directions. So, for example and not by way of limitation, the first direction can be an elevation direction, and a second direction can be an azimuth direction. Elevation can be aligned first using one or more of the process steps of the present invention, and then azimuth can be aligned using one or more of the process steps of the present invention. Tilt can be aligned next, or elevation can be realigned, or other approaches to alignment may be used without departing from the scope of the present invention. Further, this process can be repeated for different satellite signals, which may emanate from different satellites, different satellite orbital slots, and different frequencies, to further increase the precision of the alignment systems and methods of the present invention.

CONCLUSION

In summary, the present invention comprises a method, apparatus and system for aligning an antenna reflector with satellites in a satellite configuration. A method in accordance with the present invention comprises roughly aligning a reflector with a first signal based on a geographic location of the reflector, passing the reflector through an arc in a first alignment direction by turning a coarse jack screw in a first direction until a first predetermined location is reached, returning the reflector through the arc to a second predetermined location by turning the coarse jack screw in a second direction, the second predetermined location being based on a number of turns of the coarse jack screw in the second direction, and passing the reflector back through the arc by turning a fine jack screw, wherein turning the fine jack screw by the same number of turns moves the reflector half of the distance through the arc in the first direction.

Such a method further optionally comprises the coarse jack screw and the fine jack screw being turned using a transmission device, the transmission device comprises splines to selectively engage the coarse jack screw and the fine jack screw, the first alignment direction being an elevation direction, passing the reflector through a second arc in a second alignment direction by turning a second coarse jack screw in a first direction until a third predetermined location is reached, returning the reflector through the second arc to a fourth predetermined location by turning the second coarse jack screw in a second direction, the fourth predetermined location being based on a number of turns of the coarse jack screw in the second direction, and passing the reflector back through the second arc by turning a second fine jack screw, wherein turning the second fine jack screw by the same number of turns moves the reflector half of the distance through the arc in the first direction, and the coarse jack screw and the fine jack screw being concentric.

An alignment system in accordance with one or more embodiments of the present invention comprises a coarse jack screw, a fine jack screw, and a reflector, coupled to the coarse jack screw and the fine jack screw, wherein a turn of the coarse jack screw moves the reflector a first distance in a first direction and a turn of the fine jack screw moves the reflector half of the first distance in the first direction.

Such an alignment system further optionally comprises a transmission device, coupled to the coarse jack screw and to the fine jack screw, wherein the transmission device selectively engages the coarse jack screw and the fine jack screw, the transmission device being coupled to the coarse jack screw and to the fine jack screw with a splined interface, the coarse jack screw and the fine jack screw being concentric, and the coarse jack screw being turned in a direction opposite that of the fine jack screw to move the reflector in the first direction.

An alignment system for a satellite broadcasting system in accordance with one or more embodiments of the present invention comprises a terrestrial antenna comprising a reflector, the terrestrial antenna being aligned in azimuth and elevation with at least a first satellite signal transmitted by a first satellite in the satellite broadcasting system, wherein a coarse jack screw moves the reflector a first amount in an alignment axis per turn of the coarse jack screw, and a fine jack screw moves the reflector a second amount in the alignment axis per turn of the fine jack screw.

Such a system further optionally comprises the first amount being twice the second amount, the coarse jack screw and the fine jack screw being turned using a transmission device, the transmission device comprising splines to selectively engage the coarse jack screw and the fine jack screw, the coarse jack screw and the fine jack screw being concentric, and a first coarse jack screw and a first fine jack screw align the reflector in elevation and a second coarse jack screw and a second fine jack screw align the reflector in azimuth.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the full range of equivalents to the claims.

What is claimed is:

1. A method of aligning a reflector of an antenna to receive a satellite signal, comprising:

roughly aligning the reflector with a first signal based on a geographic location of the reflector;

passing the reflector through an alignment arc in a first direction to a first location in the alignment arc by turning a first jack screw in a first direction until a first location is reached;

measuring a first strength of the received signal at the first location in the alignment arc;

measuring a second strength of the received signal while passing the reflector through the alignment arc in a second direction opposing the first direction by turning the first jack screw a number of turns in a second direction opposing the first direction until the measured second strength of the received signal matches the first measured strength of the received signal; and passing the reflector back through the alignment arc in the first direction by turning a second jack screw the number of turns;

wherein the first jack screw is of coarser pitch than the second jack screw.

2. The method of claim 1, wherein the first jack screw and the second jack screw are turned using a transmission device.

3. The method of claim 2, wherein the transmission device comprises splines to selectively engage the first jack screw and the second jack screw.

4. The method of claim 1, wherein the first direction and the second direction are an elevation direction.

5. The method of claim 1, further comprising:

passing the reflector through a second alignment arc in a third direction to a first location in the second alignment arc by turning another first jack screw in a second first jack screw first direction until a second location is reached;

measuring a third strength of the received signal at the first location in the second alignment arc;

passing the reflector through the second alignment arc in a fourth direction opposing the third direction by turning the another first jack screw a second number of turns in a second first jack screw second direction opposing the second first jack screw first direction until a measured fourth signal strength of the received signal matches the measured third strength of the received signal; and passing the reflector back through the second alignment arc in the third direction by turning the another second jack screw the second number of turns.

6. The method of claim 1, wherein the first jack screw and the second jack screw are concentric.

7. The method of claim 1, wherein the satellite signal is received from a geostationary satellite, and wherein:

the reflector is passed through the alignment arc in the first direction to the first location in the alignment arc by turning only the first jack screw in the first direction until the first location is reached;

the reflector is passed through the alignment arc in the second direction opposing the first direction by turning only the first jack screw the number of turns in the second direction opposing the first direction until the measured second strength of the received signal matches the first measured signal strength; and the reflector is passed back through the alignment arc in the first direction by turning only the second jack screw only the number of turns.

8. The method of claim 1, wherein the reflector and the antenna are coupled via a transmission selectively engaging the first jack screw and the fine jack screw and wherein the method further comprises:

selectively engaging a the first jack screw with the reflector before passing the reflector through an alignment arc in the first direction to the first location in the alignment arc by turning the first jack screw in the first direction until a first location is reached; and selectively engaging the second jack screw with the reflector before passing the reflector back through the alignment arc in the first direction by turning the second jack screw the number of turns.

9. An alignment system, comprising:

a first jack screw;

a second jack screw having a finer pitch than the first jack screw;

a transmission, selectively engaging the first jack screw and the second jack screw; and a reflector, coupled to the first jack screw and the second jack screw, wherein a single turn of the first jack screw when selectively engaged moves the reflector a first amount in a first direction and a single turn of the second jack screw when selectively engaged moves the reflector half of the first amount in the first direction.

10. The alignment system of claim 9, wherein the transmission is coupled to the first jack screw and to the second jack screw with a splined interface.

11. The alignment system of claim 9, wherein the first jack screw and the second jack screw are concentric.

12. The alignment system of claim 11, wherein:

the alignment system further comprises a drive portion;

the first jack screw and the second jack screw are concentric along a drive axis;

the first jack screw comprises a first jack screw splined interface;

the second jack screw comprises a second jack screw splined interface; and the transmission comprises a member, having first member splines and second member splines;

wherein the member is slideable along the drive axis between a first position engaging the first jack screw to the drive portion via the first jack screw splined interface and the first member splines and a second position engaging the second jack screw to the drive portion via the second jack screw splined interface and the second member splines.

13. The alignment system of claim 9, wherein the first jack screw is turned in a direction opposite that of the second jack screw to move the reflector in the first direction.

14. The alignment system of claim 9, wherein:

the single turn of the first jack screw when selectively engaged moves the reflector the first amount in the first direction of an alignment arc of a plurality of geostationary satellites; and a single turn of the second jack screw when selectively engaged moves the reflector half of the first amount in the first direction of the alignment arc of the plurality of geostationary satellites.

15. A system for aligning a terrestrial antenna having a reflector to receive a signal transmitted by a satellite of a satellite broadcasting system, comprising:

a first jack screw, coupled to the reflector, for aligning the terrestrial antenna by moving the reflector a first amount in an alignment axis of the reflector per turn of the coarse jack screw;

a second jack screw having a pitch finer than the first jack screw, coupled to the reflector, for aligning the terrestrial antenna by moving the reflector a second amount in an alignment axis of the reflector per turn of the fine jack screw; and a transmission, coupled to selectively engage the first jack screw and the second jack screw;

wherein the first amount is twice the second amount.

16. The system of claim 15, wherein the first jack screw and the second jack screw are turned using the transmission.

17. The system of claim 16, wherein the transmission comprises splines to selectively engage the first jack screw and the second jack screw.

18. The system of claim 15, wherein the first jack screw and the second jack screw are concentric.

19. The alignment system of claim 18, wherein:

the system further comprises a drive portion;

the first jack screw and the second jack screw are concentric along a drive axis;

the first jack screw comprises a first jack screw splined interface;

the second jack screw comprises a second jack screw splined interface; and the transmission comprises a member, having first member splines and second member splines;

wherein the member is slideable along the drive axis between a first position engaging the first jack screw to the drive portion via the first jack screw splined interface and the first member splines and a second position engaging the second jack screw to the drive portion via the second jack screw splined interface and the second member splines.

20. The system of claim 15, wherein the alignment axis is an elevation alignment axis and the system further comprises:

another first jack screw, coupled to the reflector, for aligning the terrestrial antenna by moving the reflector in an azimuth alignment axis of the reflector a third amount per turn of the another first jack screw; and another second jack screw, coupled to the reflector, for aligning the terrestrial antenna by moving the reflector in the azimuth alignment axis of the reflector a fourth amount per turn of the another second jack screw;

wherein the third amount is twice the fourth amount.

* * * * *